US006925999B2

(12) United States Patent
Hugghins et al.

(10) Patent No.: US 6,925,999 B2
(45) Date of Patent: Aug. 9, 2005

(54) MULTISTAGE WARM AIR FURNACE WITH SINGLE STAGE THERMOSTAT AND RETURN AIR SENSOR AND METHOD OF OPERATING SAME

(75) Inventors: Gordon Jeffrey Hugghins, Jacksonville, TX (US); Leonard W. Holmes, Arp, TX (US)

(73) Assignee: American Standard International Inc., New York, NY (US)

( * ) Notice: Subject to any disclaimer, the term of this patent is extended or adjusted under 35 U.S.C. 154(b) by 36 days.

(21) Appl. No.: 10/700,282

(22) Filed: Nov. 3, 2003

(65) Prior Publication Data

US 2005/0092317 A1 May 5, 2005

(51) Int. Cl.[7] ..... F24H 3/02

(52) U.S. Cl. ..... 126/116 A; 126/110 A; 126/110 E; 236/11; 236/44 R; 431/12

(58) Field of Search ..... 126/116 R, 116 A, 126/110 A, 110 E; 236/11, 44 R; 431/2, 12; 454/239

(56) References Cited

U.S. PATENT DOCUMENTS 4,172,555 A 10/1979 Levine
4,337,893 A 7/1982 Flanders et al.
4,361,273 A * 11/1982 Levine et al. ..... 126/113
4,408,278 A 10/1983 Saito et al.
4,417,688 A 11/1983 Schnaibel et al.
4,442,972 A 4/1984 Sahay et al.
4,467,616 A 8/1984 Kitauchi
5,865,611 A * 2/1999 Maiello ..... 126/116 A
5,911,747 A * 6/1999 Gauthier ..... 62/176.6

* cited by examiner

*Primary Examiner*—Jiping Lu
(74) *Attorney, Agent, or Firm*—William J. Beres; William O'Driscoll

(57) ABSTRACT

A multistage furnace for heating residential or commercial spaces is operated by a single stage thermostat and a return air temperature sensor providing sensed temperature information to a controller. The furnace is started at a first, low firing rate and after a predetermined time is increased to a second firing rate if the rate of change of temperature of air returning to the furnace from the space is less than a predetermined amount. The method of operation is carried further to increase the firing rate to second and third rates based on predetermined rates of temperature change of return air from the enclosed space as sensed by the return air sensor.

24 Claims, 4 Drawing Sheets

MULTISTAGE WARM AIR FURNACE WITH SINGLE STAGE THERMOSTAT AND RETURN AIR SENSOR AND METHOD OF OPERATING SAME

BACKGROUND

Multistage warm air furnaces are known for use in systems for heating residential dwellings and commercial buildings. In prior art multistage warm air furnace systems a multistage thermostat has been used to call for respective lower and higher firing rates to satisfy the demand of the space being heated. The cost of multistage thermostats and the installation of same has been a consideration when installing multistage furnaces. Efforts to provide lower cost single stage thermostats for controlling multistage furnaces have not been entirely successful.

One technique for operating a multistage furnace with a single stage thermostat has been the provision of a control algorithm which is time based. The furnace is operated in an "on—off" mode with a single stage thermostat and a time based algorithm determines when the furnace is to be transitioned from a lower firing rate to a higher firing rate. This approach has certain disadvantages including noise generated by the furnace and excessive temperature swings in the controlled space. However, a single stage thermostat operating with a multistage furnace is desirable in instances where multistage furnaces are retrofitted into a building in which one or more single stage thermostats already exist. Moreover, as mentioned above, single stage thermostats are less expensive than multistage thermostats which also favors using a single stage thermostat with a multistage furnace.

Accordingly, there has been a desire to provide an improved system and method for controlling a warm air furnace, particularly a multistage furnace with a single stage thermostat, and it is to these ends that the present invention has been developed.

SUMMARY OF THE INVENTION

The present invention provides a warm air furnace control system including a single stage thermostat and a return air sensor operating in conjunction with a controller or control circuit to provide improved performance of warm air furnaces and to facilitate retrofitting multistage furnaces into facilities which include single stage thermostats.

In accordance with one aspect of the present invention, a multistage furnace may be operated with a single stage thermostat and a return air temperature sensor for measuring the temperature of air returning to the furnace over time and utilizing the measurements to determine whether the furnace is achieving the recovery or demand of the controlled space at a desired rate.

The present invention also includes a method embodied in a control algorithm for the system to control the furnace to operate at the lowest firing rate commensurate with the demand of the space being warmed by the furnace. The control system operates the furnace at higher or lower firing rates as determined by the conditions defined in the control algorithm.

In accordance with the invention, the controlled space is allowed to recover to the desired temperature in a manner that is consistent with predefined space comfort parameters. For example, lower furnace firing rates have proven to provide greater satisfaction of the furnace user due to reduced noise emitted by the furnace and reduced temperature variations in the controlled space.

In accordance with another aspect of the present invention, a method for operating a multistage furnace with a single stage thermostat is provided wherein the thermostat can terminate furnace operation by ending the call for heat in a conventional manner. However, while the furnace operates at respective firing rates, the return air temperature is sampled periodically at a predefined rate during furnace operation, each measurement is saved and used for a comparison with the next measurement so that a determination can be made as to whether or not the return air temperature is increasing or decreasing. The rate of return air temperature change is also determined. For example, if the temperature is decreasing or not increasing at a predefined rate, the method of the invention commands the furnace to the next higher firing rate and after a predetermined period of time, if the return air temperature is increasing, but not at a sufficient rate of recovery, the furnace is commanded to the next higher firing rate. However, if the return air temperature is increasing at a sufficient rate, the furnace continues to operate at the lowest firing rate permissible.

In accordance with a further aspect of the present invention, a control system and control method for a warm air furnace is provided wherein it is determined if the furnace should be operating at a higher or lower firing rate or remain at its present rate. Predetermined rates of temperature change are established and the furnace is commanded to operate at a particular firing rate depending on a particular rate of change of temperature sensed by a return air sensor. Accordingly, an improved furnace control system and method of operation are provided by the invention which takes advantage of single stage thermostats and multistage furnaces operating together.

Those skilled in the art will further appreciate the above mentioned advantages and superior features of the invention together with other important aspects thereof upon reading the detailed description which follows in conjunction with the drawings.

DETAILED DESCRIPTION OF THE PREFERRED EMBODIMENT

Figure 1:
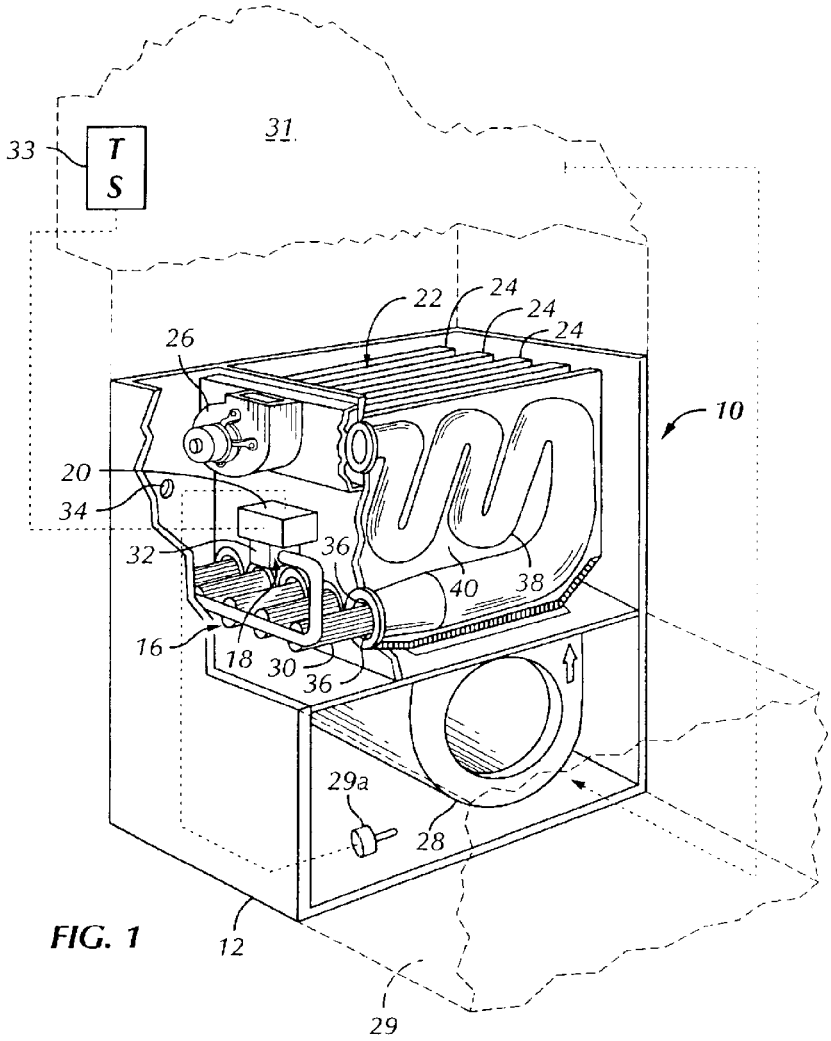
FIG. 1 is a cutaway view of a forced flow warm air gas furnace including a single stage thermostat, furnace controller and return air sensor providing for operation of the furnace in accordance with the invention.

In the description which follows, like elements are marked throughout the specification and drawings with the same reference numerals, respectively. The drawing figures are not necessarily to scale and flow diagrams or flowcharts may show only essential steps of the improvements of the present invention while conventional or ancillary operating steps may be omitted in the interest of clarity and conciseness. The letters Y and N in a flowchart mean "yes" and "no".

Referring to FIG. 1, there is illustrated a forced air multistage gas furnace of a type which may be operated in accordance with the present invention and is generally designated by the numeral 10. Furnace 10 includes a generally rectangular cabinet 12 in which is disposed a burner assembly 16, a gas valve assembly 18 operably connected to a source of gas, not shown, and a controller 20. Controller 20 is preferably a programmable microcontroller of a type commercially available and which may be programmed to carry out the method of the invention by one of ordinary skill in the art. A heat exchanger assembly 22 includes plural heat exchangers 24 and an induced draft blower 26. A circulating air blower 28 is disposed in cabinet 12 and draws air from a return air duct 29 in which is disposed a temperature sensor 29*a*. Sensor 29*a* is operably connected to controller 20 for transmitting signals thereto indicating the temperature of air returned from an enclosed space 31 which is to be heated by the furnace 10. Although an upflow type furnace is illustrated in FIG. 1, those skilled in the art will recognize that other conventional gas furnaces or other types of forced airflow furnaces may be operated in accordance with the present invention.

Enclosed space 31 includes a temperature sensor or thermostat 33 which is also in signal transmitting communication with the controller 20. In multistage furnaces operating with multistage thermostats there are typically multiple thermostat signal conductors connected to corresponding plural terminals of a controller, such as controller 20. In accordance with the present invention a single signal transmitting conductor from thermostat 33 may be connected to each of the thermostat signal receiving terminals of controller 20 and operation of the controller is carried out in accordance with the methods set forth herein.

Referring further to FIG. 1, burner assembly 16 includes plural inshot burners 30 manifolded to a supply of fuel supplied from gas valve assembly 18 which includes a variable position gas control valve 32, so that an appropriate fuel-air mixture is provided to the burners 30. Combustion air may enter the cabinet 12 through a combustion air inlet 34. Suitable ignitors 36 are arranged to ignite a fuel-air mixture and the hot gases produced thereby circulate through serpentine passages 38. Induced draft blower 26 may be controlled by pressure switches, not shown, also operable to provide signals to the controller 20.

The temperature sensor or thermostat 33 may be characterized as a single stage thermostat as mentioned above but the furnace 10 may be operable in multiple stages at various firing rates. For example, the furnace 10 may be called upon to provide heat at a so-called low firing or heating rate in a first stage call from a multistage thermostat and then called upon to provide heat at a mid range firing or heating rate, and then a high firing or heating rate if the demand for heat is not satisfied at the lower rates. However, if a single stage type thermostat is used with a multistage furnace controller, such as used in prior art systems, the multistage furnace may not be capable of taking advantage of the efficiencies and comfort sensed by occupants of the heated space by generating heat at various selected rates.

In accordance with the present invention, temperature sensor 29, which may be disposed in various positions, such as in return air duct 29, within the cabinet 12 upstream of blower 28, or elsewhere, measures the temperature of air returning from space 31 to the furnace 10. Periodic temperature measurements taken by sensor 29*a* are used to make a determination as to whether or not the space 31 is recovering, that is, being heated at a predefined rate. By providing a control method in accordance with the invention, the controller 20 may operate the furnace 10 at a higher or lower firing rate by controlling gas flow with a variable position control valve, such as the valve 32, and as determined by the conditions defined in the method. Of course, in the interest of savings of fuel and the cost of heating, the method is adapted to operate the furnace 10 at the lowest firing rate consistent with obtaining recovery of the desired temperature within the space 31. In other words, the space 31 is allowed to recover temperature in a manner that is consistent with comfort norms that have been defined for persons occupying heated spaces, for example. Moreover, lower firing rates of gas furnaces and the like have proven to provide greater comfort due to reduced noise emitted from the furnace and better temperature control.

In accordance with a preferred embodiment of the invention, three stages of furnace operation are provided by way of example. The invention contemplates that furnaces operable at various numbers of firing stages or rates may be operated in accordance with the invention and a three stage furnace and single stage thermostat are described as one preferred example. At any time during the process of firing the furnace 10 to satisfy the call for heat within the space 31, the thermostat 33 may end the call for heat by terminating furnace operation, that is by closing gas valve 32 under control of the controller 20. When operating at the lowest firing rate, the return air temperature sensed by sensor 29 is sampled at a selected frequency during furnace operation. Each successive measurement is saved and used for comparison with the next following measurement. Accordingly, the first temperature measurement establishes a starting point temperature for the method and subsequent temperature measurements are taken at predetermined periods, such as every fifteen seconds to every five minutes, for example. In this way a determination is made by the controller 20 as to whether or not temperature in the space 31 is increasing or decreasing. If the temperature in space 31 is increasing, as sensed by the temperature of return air flowing through duct 29, a rate of change in temperature sensed is calculated. If the temperature of return air in duct 29 is decreasing, the method contemplates commanding the furnace 10 to operate at the next higher firing rate. Once this command is given, after a predetermined period of operation, if the temperature of return air is increasing, but not at a predetermined sufficient rate of recovery, the furnace 10 is commanded to operate at the next higher firing rate. On the other hand, if the temperature of the return air is increasing at a sufficient rate the furnace continues to operate at the same or a lower firing rate and temperature sampling is continued.

If the furnace 10 is operating at a mid range or middle firing rate, the method contemplates providing the ability to determine if the furnace should be operating at a higher or a lower firing rate or stay at the middle rate. For example, if the return air temperature sensed by sensor 29 continues to decrease, the firing rate is increased to the high firing rate after a predetermined period of operation at the middle firing rate, such as five minutes, for example. After a predetermined time of middle firing rate, that is, for example, ten minutes, the rate of temperature recovery in space 31 is again calculated. If the rate of recovery is greater than a predetermined amount, the furnace is transitioned back to the low firing rate. However, if the rate of recovery is below a predetermined designated rate the firing rate is increased to the high firing rate. Still further, if the rate of recovery of the temperature in the space 31 is at a predetermined target rate then the furnace is commanded to continue to operate in the middle range or middle rate and temperature sampling is continued.

Still further, in accordance with the invention, when the furnace 10 is operating at the high firing rate the method contemplates providing the ability to determine if the furnace should continue to operate at that rate or operate at the middle firing rate. This may also be carried out by sensing return air temperature with the sensor 29 and, if the temperature continues to decrease or if the rate of recovery of temperature in the space 31 is at the predetermined target rate or less, the furnace continues to operate at the high rate while temperature sampling with the sensor 29 and the controller 20 is continued. If the rate of temperature recovery is too high under these operating conditions the furnace 10 is commanded to return to operation at the middle firing rate while temperature sensing is continued. The process described hereinabove is, of course, continued until the call for heat by the sensor or thermostat 33 is satisfied at which time the furnace shuts off until the temperature in the space 31 decreases below the thermostat setpoint a predetermined amount in accordance with conventional thermostat operation.

Figure 2A:
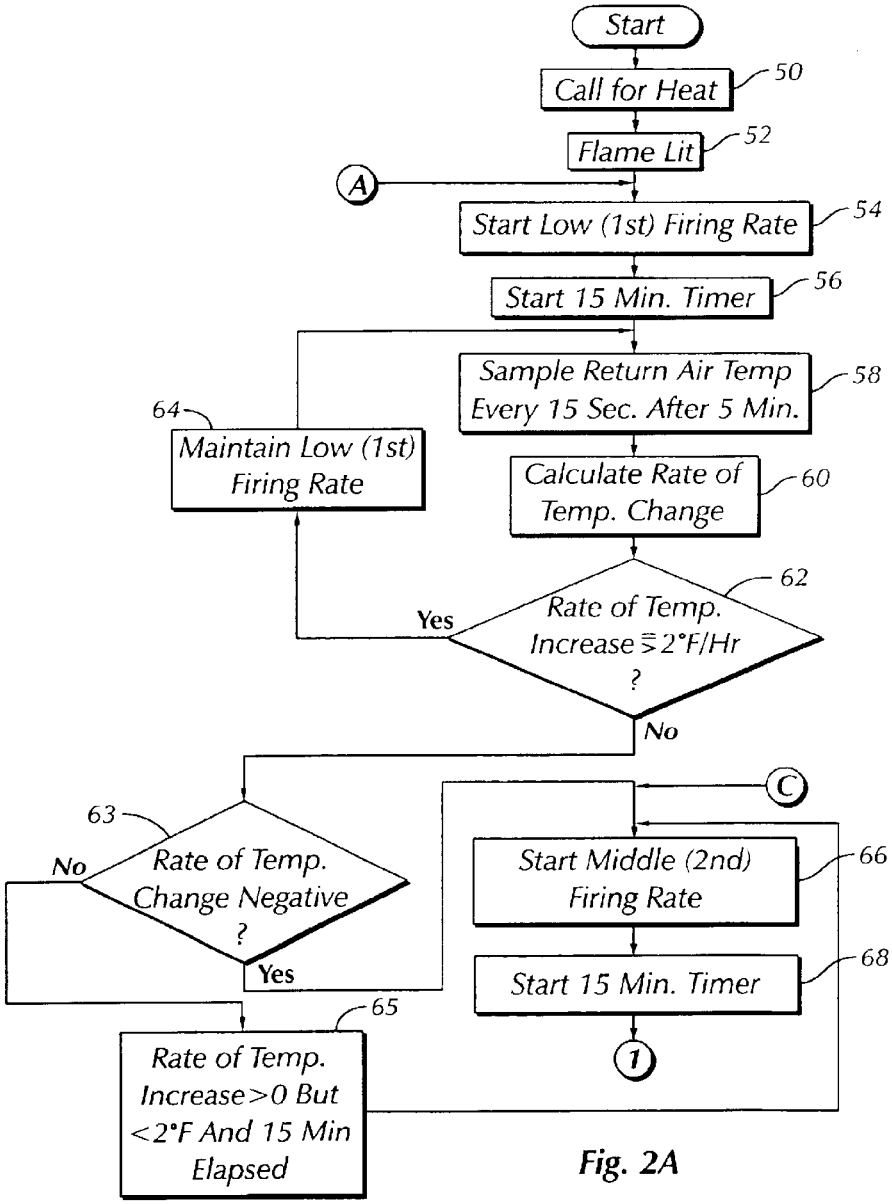
FIGS. 2A through 2C comprise a flow chart of the operation of the furnace in accordance with the present invention.
Figure 2B:
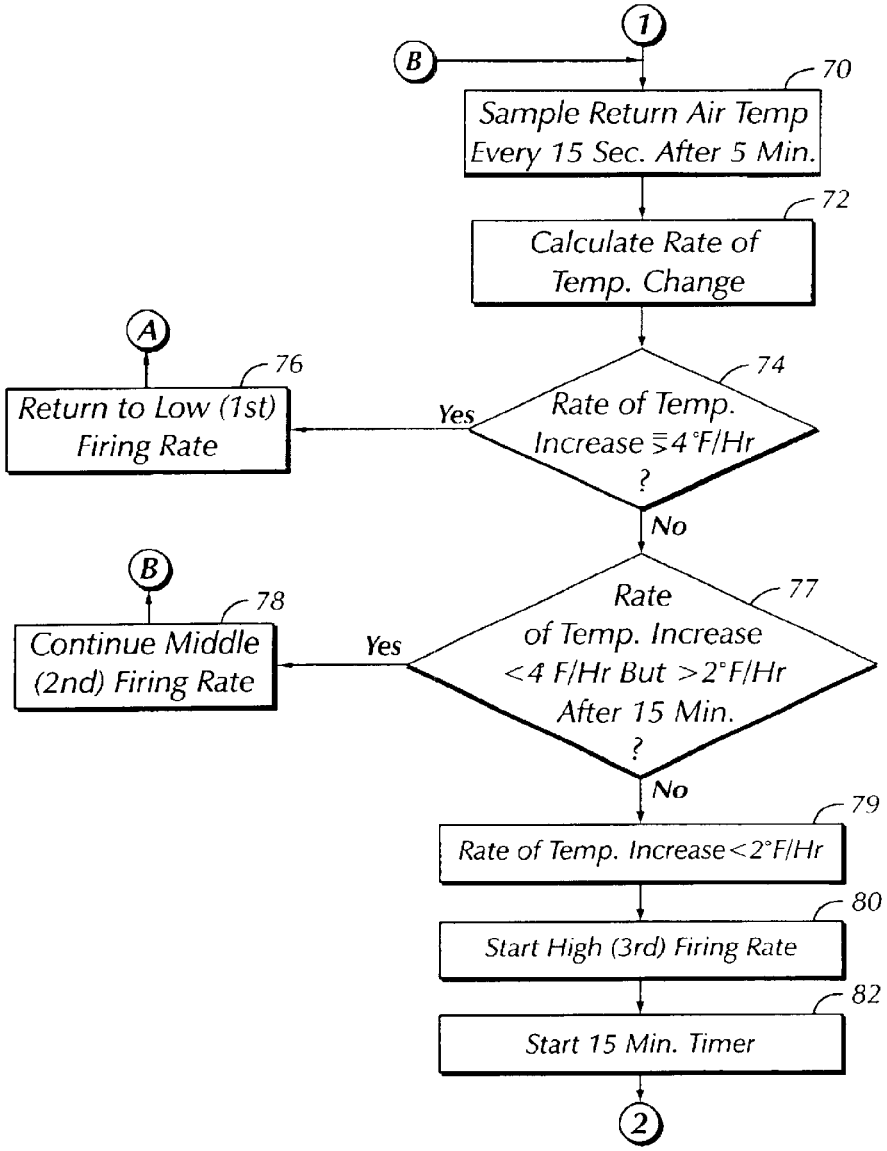
Figure 2C:
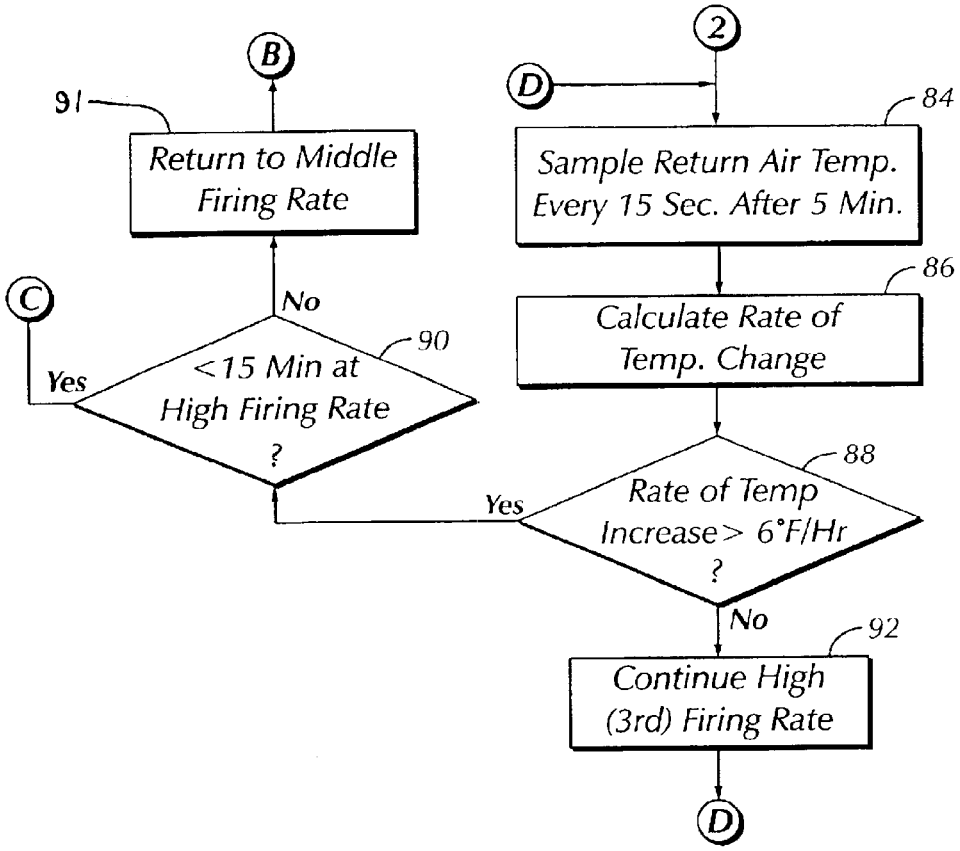

Referring now to FIGS. 2A through 2C, there is illustrated a flow chart of an exemplary and preferred method of controlling a multistage furnace, such as the furnace 10, with a single stage thermostat by incorporating a routine in the controller 20 in accordance with the method of the invention. Referring to FIG. 2A, in particular, when furnace 10 including the controller 20, is enabled at the step labeled "Start" and the thermostat 33 calls for heat at step 50 in FIG. 2A, the controller 20 opens gas valve 32 and energizes ignitors 36 to light flame in the burners 30, as indicated at step 52. Normally, the furnace flame is lit and established at a furnace firing rate greater than the lowest firing rate in order to assure that the flame actually becomes established and stabilized. After a short time delay, typically about forty-five seconds, the furnace firing rate then transitions to the "low" or first stage rate. Accordingly, once the furnace 10 is energized and flame is established, controller 20 adjusts gas valve 32 and blower 26 to operate at a "low" or first stage firing or heating rate, as indicated at step 54 in FIG. 2A. With the gas valve 32 and the inducer blower 26 operating at the low or first stage firing rate a time delay process is simultaneously commenced by starting a fifteen minute timer at step 56.

Upon energizing the furnace 10 at the low firing rate the return air temperature sensed by sensor 29 is sampled every fifteen seconds after the first five minutes of operation, as indicated at step 58. Each sampling of return air temperature is compared with a previous sampling to determine the rate of temperature change in degrees Fahrenheit (F) per hour (HR) as indicated at step 60. After five minutes of operation, if the rate of temperature change (increase), as sensed by sensor 29, is equal to or greater than two degrees Fahrenheit (F) per hour, as indicated at step 62, the furnace continues to operate at the low firing rate, as indicated at step 64. Of course, in this routine the return air temperature is continued to be sampled every fifteen seconds after a five minute interval, the temperature rate of change in degrees F per hour is calculated, and the rate of temperature change is monitored.

Referring further to FIG. 2A, and also FIG. 2B, if the rate of temperature change is negative after five minutes elapsed time from step 58, but less than fifteen minutes, step 63, the furnace 10 is commanded to start the middle firing or heating rate as indicated by step 66. The controller 20 also opens the gas valve 32 further and increases the speed of the inducer blower 26 to begin the "middle" or second stage firing, rate. If the rate of temperature change is positive but less than two degrees F per hour after fifteen minutes, step 65, the middle or second stage firing rate begins also. With initiation of step 66 a fifteen minute timing cycle is begun at step 68. The return air temperature, as sensed by sensor 29, is again sampled every fifteen seconds after five minutes of operation at the middle or second stage firing rate as indicated at step 70 in FIG. 2B. The rate of temperature change is calculated at step 72, as in step 60, and, after five minutes, if the rate of temperature increase at step 74 is equal to or greater than four degrees F per hour, for example, the controller 20 will reset the gas valve 32 to the low firing rate and reduce the speed of the inducer blower 26, as indicated at step 76. The process flow is entered at the encircled A in FIG. 2A which starts the low firing rate all over again, including initiation of the fifteen minute timer, step 56.

Referring further to FIG. 2B, if the rate of temperature increase at step 74 is less than four degrees F per hour but greater than two degrees F per hour and fifteen minutes has elapsed, as indicated at step 77, the furnace continues to operate at the middle or second stage firing rate, as indicated at step 78, wherein the routine is continued from the point of entry at the encircled B. In this mode, the fifteen minute time interval is not initiated but the process continues to sample the return air temperature in the duct 29 every fifteen seconds and, after five minutes, if the rate of temperature increase is equal to or greater than four degrees F per hour, the system will return to the low or first stage firing rate, as indicated by step 76.

If the rate of temperature increase is less than two degrees F per hour at the middle firing rate, as indicated at step 79, the controller 20 will cause the gas valve 32 and the inducer blower 26 to begin operating at the "high" or third stage firing or heating rate, as indicated at step 80 in FIG. 2B. Upon initiation of the third stage firing rate, a fifteen minute timer is initiated, also at step 82. The return air temperature is sensed by the sensor 29 every fifteen seconds after five minutes, as indicated at step 84, and the rate of temperature change is calculated at step 86.

Referring to FIG. 2C, if the furnace 10 is producing a rate of temperature increase of return air in duct 29 at greater than six degrees F per hour when operating in the high firing rate, and the rate of temperature increase has exceeded six degrees F per hour before the fifteen minute timing cycle has elapsed, as indicated at step 90, the controller 20 initiates operation of furnace 10 again at the middle or second stage firing rate and a fifteen minute timing cycle is initiated, as indicated by entry in the routine at the encircled letter C in FIG. 2A. On the other hand if the rate of temperature increase is greater than six degrees Fahrenheit per hour after the first fifteen minutes of operation at the high firing rate, the controller 20 will return the furnace mode of operation to that of operating at the middle firing rate as indicated at step 91, but entry into the routine is at the point indicated by the encircled letter B in FIG. 2B. This is the same routine that is effective if, when the system is operating at the middle firing rate, the rate of temperature increase is less than four degrees F per hour but greater than two degrees F per hour.

Referring further to FIG. 2C, if the rate of temperature increase is less than six degrees F per hour at the high firing or heating rate, as indicated at step 88 the furnace continues operating at the high rate, step 92, by running the routine indicated in FIG. 2C wherein the method steps are entered at the encircled letter D.

As mentioned previously, the controller 20 may be fitted with or modified to include a processor which will accept programming to carry out the method steps set forth above and utilizing a single stage thermostat which, basically, is suited for signaling the controller 20 when a temperature within a particular range above and below a setpoint is reached in accordance with conventional thermostat operation. Moreover, by providing a controller and a return air temperature sensor arranged with respect to the furnace generally upstream of the main circulating blower, and preferably in a return air duct, multistage, furnaces may be retrofitted into facilities having single stage thermostats already in place while providing for multistage furnace operation.

One preferred embodiment of the invention has been described in detail herein wherein a multistage furnace, typically a furnace capable of operating at three firing rates or heating rates, is operated in conjunction with a thermostat capable of providing only a single stage signal to the furnace controller. However, the system and method of the invention are operable in conjunction with other furnaces having multiple firing or heating rates whose stage numbers are greater than that of the signal generating capability of the thermostat. For example, the invention may be adapted for operation of a five stage furnace, that is a furnace having five firing rates or heating rates and operable in conjunction with a two stage thermostat, or a thermostat capable of operating at three stages. Also, for example, if a two stage thermostat was operating with a three stage furnace, the thermostat would be operable to control operation of the furnace at its first or lowest firing rate, for example, and then in the second stage of thermostat operation or signal transmission to the furnace controller, the method of the invention would be implemented to operate the furnace at its second and third stages of operation. When multistage thermostats are operated with multistage furnaces in accordance with the invention transition from one stage or heating rate called for by the thermostat to the next higher rate called for by the thermostat is based on elapsed time. In other words if heating demand is not satisfied at a lower rate the thermostat calls for a higher rate at the termination of a preset period of time at the lower rate. However, when the thermostat sends its second or last stage signal to the controller, the process of the present invention is implemented.

Another example of how the invention might be utilized in a situation where a thermostat having fewer numbers of furnace stage operating signals than the furnace was capable of would be where the furnace was capable of operating at five heating rates or firing rates and the thermostat was only operable to provide signals at two stages of operation of the furnace. In this situation the thermostat would provide a signal to operate the furnace at its first stage rate and the thermostat, when calling for heat at its second stage operating condition would then control the furnace for operation at the second, third, fourth and fifth stages of operation of the furnace generally in accordance with the present invention. Thus, the invention basically contemplates a method of operating a multiple stage furnace with a thermostat operable to provide a signal or signals to the furnace controller to call for heat at furnace heating rates less than the number of "stages" or heating rates of which the furnace is capable. However, implementation of the method of the invention by a furnace controller enables a furnace to be operated in an efficient manner with a thermostat capable of providing signals for operating the furnace at heating rates less than of which the furnace is capable.

Although a preferred embodiment of the invention has been described in detail herein, those skilled in the art will recognize that various substitutions and modifications may be made without departing from the scope and spirit of the appended claims.

What is claimed is:

1. A method for controlling operation of a heating system, said heating system including a furnace operable to provide heat to an enclosed space at plural heating rates, a controller for controlling operation of said furnace at selected ones of said plural heating rates, a thermostat for sensing the temperature in an enclosed space being heated by said furnace and for providing a signal or signals to said controller to call for heat at furnace heating rates less than the number of stages of heating rates of which said furnace is capable, and a sensor for sensing air returning from said enclosed space to said furnace for heating thereby, said method comprising the steps of:

energizing said furnace at a first heating rate in response to a signal from said thermostat;

sensing the return air temperature with said sensor;

determining at least one of the return air temperature and the rate of return air temperature change versus time; and changing the heating rate of said furnace if said one of return air temperature and rate of change of return air temperature is one of less than and greater than a predetermined amount.

2. The method set forth in claim 1 including the step of:

changing the heating rate of said furnace only after a predetermined time has elapsed from energizing said furnace at a selected heating rate.

3. The method set forth in claim 1 including the step of:

increasing the heating rate of said furnace from a first stage to a second stage if the rate of change of temperature of return air is less than said predetermined amount.

4. The method set forth in claim 1 including the step of:

maintaining the heating rate of said furnace at one of said plural heating rates if the rate of change of temperature of return air is less than a first predetermined amount but greater than a second predetermined amount.

5. The method set forth in claim 4 including the step of:

maintaining said one heating rate after a predetermined elapsed time from initiation of said one heating rate.

6. The method set forth in claim 4 including the step of:

increasing the heating rate of said furnace if the rate of change of return air temperature is less than said second predetermined amount.

7. The method set forth in claim 1 including the step of:

decreasing the heating rate of said furnace if the rate of change if return air temperature is greater than said predetermined amount.

8. The method set forth in claim 1 including the step of:

increasing the heating rate of said furnace if the rate of change of return air temperature is negative.

9. The method set forth in claim 1 including the step of:

de-energizing said furnace when the temperature of air in said space reaches a predetermined amount as sensed by said thermostat.

10. The method set forth in claim 1 wherein:

said furnace is operable to generate heat at a first heating rate, a second and greater heating rate, and a third and still greater heating rate, and said method comprises the steps of:

causing said furnace to generate heat at said first heating rate upon receiving a signal by said controller from said thermostat and changing said heating rate from said first heating rate to said second heating rate only after a first predetermined period of time regardless of the rate of return air temperature change.

11. The method set forth in claim 10 including the step of:

maintaining the heating rate of said furnace at said first heating rate after said first predetermined period of time if the rate of temperature increase sensed by said return air sensor is greater than a first predetermined amount.

12. The method set forth in claim 11 including the step of:

energizing said furnace at said second heating rate if the rate of temperature increase sensed by said return air sensor is less than said first predetermined amount.

13. The method set forth in claim 12 including the steps of:

initiating a second predetermined period of time upon energizing said furnace at said second heating rate, and;

causing said furnace to maintain said second heating rate if the rate of return air temperature increase after said second predetermined period of time is greater than a second predetermined amount but less than said first predetermined amount.

14. The method set forth in claim 12 including the step of:

causing said furnace to generate heat at a third heating rate if the rate of return air temperature increase at said second heating rate is less than said second predetermined amount.

15. The method set forth in claim 14 including the steps of:

initiating a third predetermined period of time upon causing said furnace to generate heat at said third heating rate, determining the rate of temperature change of said return air and, after expiration of said third predetermined period of time, returning operation of said furnace to said second heating rate if the rate of temperature increase of said return air is greater than a third predetermined amount.

16. The method set forth in claim 15 including the step of:

continuing the operation of said furnace at said third heating rate if the rate of temperature increase of said return air is less than said third predetermined amount.

17. The method set forth in claim 1 including:

a multistage furnace operable in accordance with said method to provide heat to said enclosed space at a selected one of said plural heating rates.

18. The method set forth in claim 17 wherein:

said furnace comprises a fossil fuel fired furnace including a fuel flow control valve.

19. The method set forth in claim 18 wherein:

said control valve is operably connected to a controller and is operable to control fuel flow to said furnace at multiple flow rates.

20. The method set forth in claim 1 including:

a return air sensor operably connected to a controller for said furnace to sense the temperature of air circulating from said space to said furnace.

21. The method set forth in claim 20 wherein:

said return air sensor is disposed in a return air duct connected to said furnace upstream of a blower for circulating air through said furnace.

22. The method set forth in claim 1 including:

a thermostat operably connected to a controller for said furnace for providing a call for heat signal or signals to said controller at heating rates of said furnace less than which said furnace is capable of operating.

23. The method set forth in claim 22 wherein:

said thermostat is a single stage thermostat.

24. The method set forth in claim 1 including:

a controller operably connected to a thermostat for said furnace, said controller being programmable to operate in accordance with said method.

* * * * *